US005898451A

United States Patent [19]

Kaplinsky et al.

[11] Patent Number: 5,898,451

[45] Date of Patent: Apr. 27, 1999

[54] METHOD FOR INK-JET PRINTING USING A COLLAPSIBLE INK RESERVOIR STRUCTURE AND PRINTER INK CARTRIDGE

[75] Inventors: George T. Kaplinsky, San Diego; David W. Swanson, Escondido; Tofigh Khodapanah, San Diego, all of Calif.; James E. Clark, Albany, Oreg.

[73] Assignee: Hewlett-Packard Company, Palo Alto, Calif.

[21] Appl. No.: 09/096,711

[22] Filed: Jun. 12, 1998

Related U.S. Application Data

[62] Division of application No. 08/240,297, May 9, 1994, Pat. No. 5,767,882, which is a continuation of application No. 07/929,615, Aug. 12, 1992.

[51] Int. Cl.[6] ..... B41J 2/175

[52] U.S. Cl. ..... 347/87

[58] Field of Search ..... 347/85, 86, 87

[56] References Cited

U.S. PATENT DOCUMENTS

| | | | |
|---|---|---|---|
| 4,422,084 | 12/1983 | Souto | 347/7 |
| 4,703,332 | 10/1987 | Crotti et al. | 347/87 |
| 4,992,802 | 2/1991 | Dion et al. | 347/87 |
| 5,103,243 | 4/1992 | Cowger | 347/87 |
| 5,280,300 | 1/1994 | Fong et al. | 347/87 |
| 5,359,353 | 10/1994 | Hunl et al. | 347/86 |
| 5,448,818 | 9/1995 | Scheffelin et al. | 347/86 |
| 5,450,112 | 9/1995 | Scheffelin | 347/87 |

FOREIGN PATENT DOCUMENTS

| | | | |
|---|---|---|---|
| 204569 | 11/1984 | Japan . | |
| 158460 | 7/1986 | Japan | 347/86 |

*Primary Examiner*—N. Le
*Assistant Examiner*—Anh T. N. Vo

[57] ABSTRACT

A method for ink-jet printing including providing a collapsible ink reservoir structure to facilitate assembly of a replaceable or refillable printer ink cartridge, the cartridge being formed of a relatively rigid frame (20) and flexible membranes (22, 24) forming an ink reservoir having side walls which collapse to a substantially flat shape to minimize the amount of ink remaining in the reservoir structure after computer generated printing has depleted the ink from the cartridge. The ink reservoir structure is a separate unit which is assembled and mounted in an outer housing (10) to form an ink cartridge and preferably contains an ink pressure regulator (30) which maintains a negative pressure therein.

3 Claims, 2 Drawing Sheets

METHOD FOR INK-JET PRINTING USING A COLLAPSIBLE INK RESERVOIR STRUCTURE AND PRINTER INK CARTRIDGE

CROSS REFERENCE TO RELATED APPLICATIONS

This is a divisional of application Ser. No. 08/240,297, filed May 9, 1994, which in turn is a file wrapper continuing application of application Ser. No. 07/929,615, filed Aug. 12, 1992.

BACKGROUND OF THE INVENTION AND PRIOR ART

The present invention relates generally to ink cartridges for high speed computer driven printers such as inkjet printers and plotters. In such printers the ink reservoir is ordinarily maintained under a sub-atmospheric or negative pressure so that ink will not leak or drool from the printhead. Various types of ink reservoirs may be used including refillable ink reservoir cartridges which are mounted on the moveable printer carriage, throwaway replaceable cartridges which are mounted on the printer carriage and remote or offboard ink reservoirs from which ink is drawn to the print head by tubing. In the onboard refillable or throwaway cartridges, a polymer foam is ordinarily provided in the ink reservoir so that the capillary action of the foam will prevent ink from drooling from the printhead. Polymeric foams of the type typically used for this purpose are non-biodegradable and thus cause environmental problems whenever a previously used cartridge is emptied and thrown away. In addition, the use of industrial foam in the ink reservoir restricts the operating pressure range of the ink cartridge and such foams ordinarily leave a chemical residue which is incompatible with and/or reacts adversely with printer ink. Similarly, the relatively long tubing used to convey ink from an offboard pressure reservoir to a printing head does not lend itself well for different printing pressure ranges.

It is accordingly an object of the present invention to provide a collapsible ink reservoir structure and a printer ink cartridge containing it which is easy to construct and which obviates the above difficulties.

SUMMARY OF THE INVENTION

The present invention accordingly provides an ink reservoir structure for a printer ink cartridge in which ink is to be maintained under negative pressure and an ink print head in fluid communication with said reservoir structure, said structure comprising:

a) a rigid frame having a pair of peripherally extending edges on opposite sides thereof and an ink discharge port;

b) a pair of flexible impervious membranes sealingly joined to said edges of said frame to form, with said frame, said ink reservoir structure.

The present invention further provides a printer ink cartridge comprising: a rigid housing containing an ink reservoir structure in which ink is to be maintained under negative pressure and an ink print head in fluid communication with said reservoir structure, said structure comprising:

a) a rigid frame having a pair of peripherally extending edges on opposite sides thereof and an ink discharge port;

b) a pair of flexible impervious membranes sealingly joined to said edges of said frame to form, with said frame, said ink reservoir structure.

DESCRIPTION OF THE PREFERRED EMBODIMENT

Figure 1:
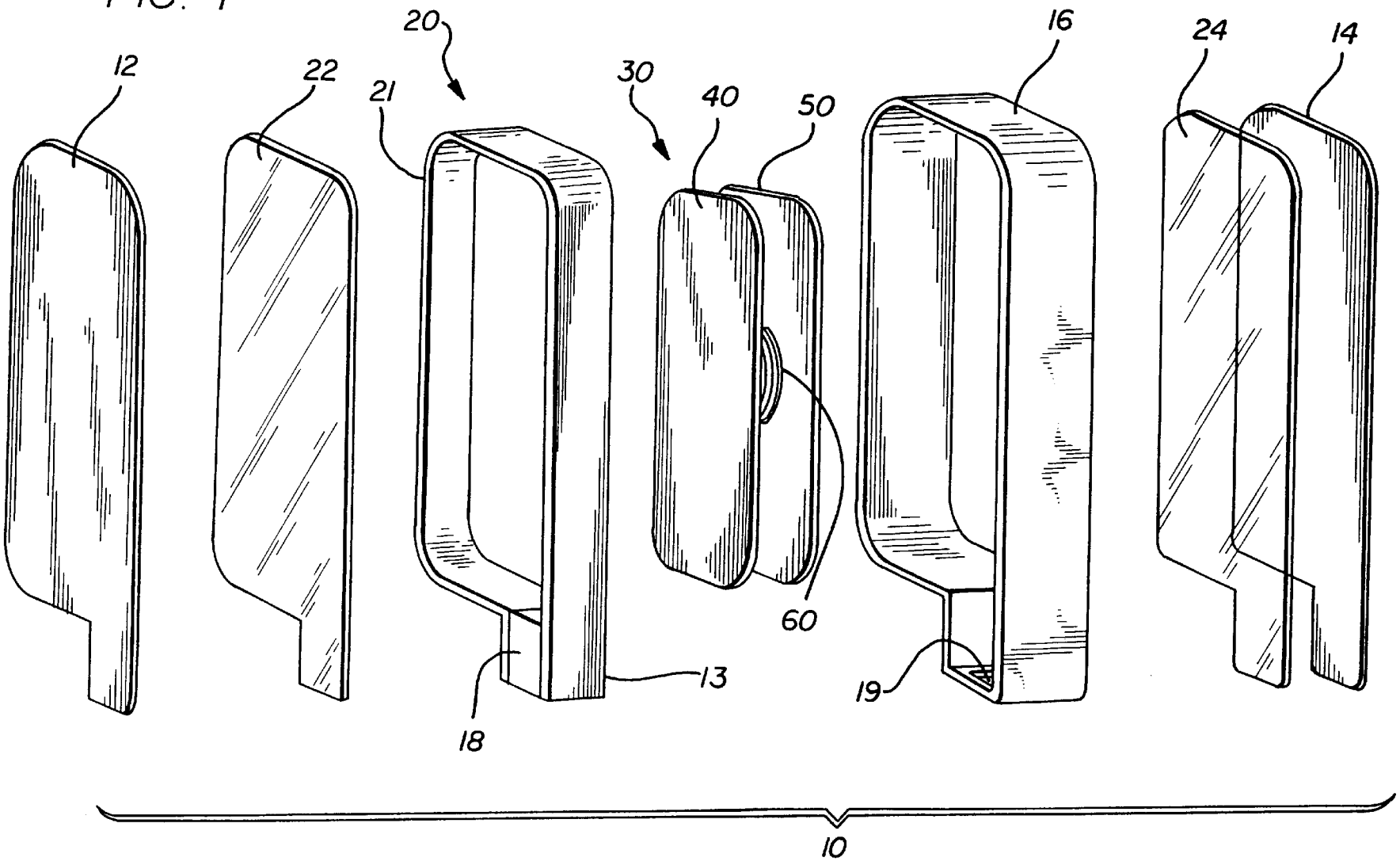
FIG. 1 is an exploded perspective view of a replaceable or throwaway ink cartridge for a thermal inkjet printer containing a collapsible ink reservoir structure.

A replaceable ink cartridge is seen in FIG. 1 to comprise a rigid outer housing 10 having a pair of spaced cover plates 12, 14 intended to be affixed as by cementing to opposite sides of a plastic peripheral wall section 16. Snout portion 13 of the cartridge has an ink discharge aperture in its lowermost end wall (as seen in FIG. 1) to which is affixed an electrically driven print head, not shown.

A reservoir structure unit comprised of a relatively rigid inner plastic frame 20 and flexible ink bag membranes 22, 24 attached thereto is mounted in the outer housing 10. Alternatively, inner frame 20 can be formed integrally with the outer housing 10 in an injection molding process. Preferably, frame 20 is formed of a softer and lower melting point plastic than housing 10 to permit heat bonding of the membranes 22 thereto. Such can be accomplished in a two-step molding process as is well within the skill of a person skilled in the art.

Figure 2:
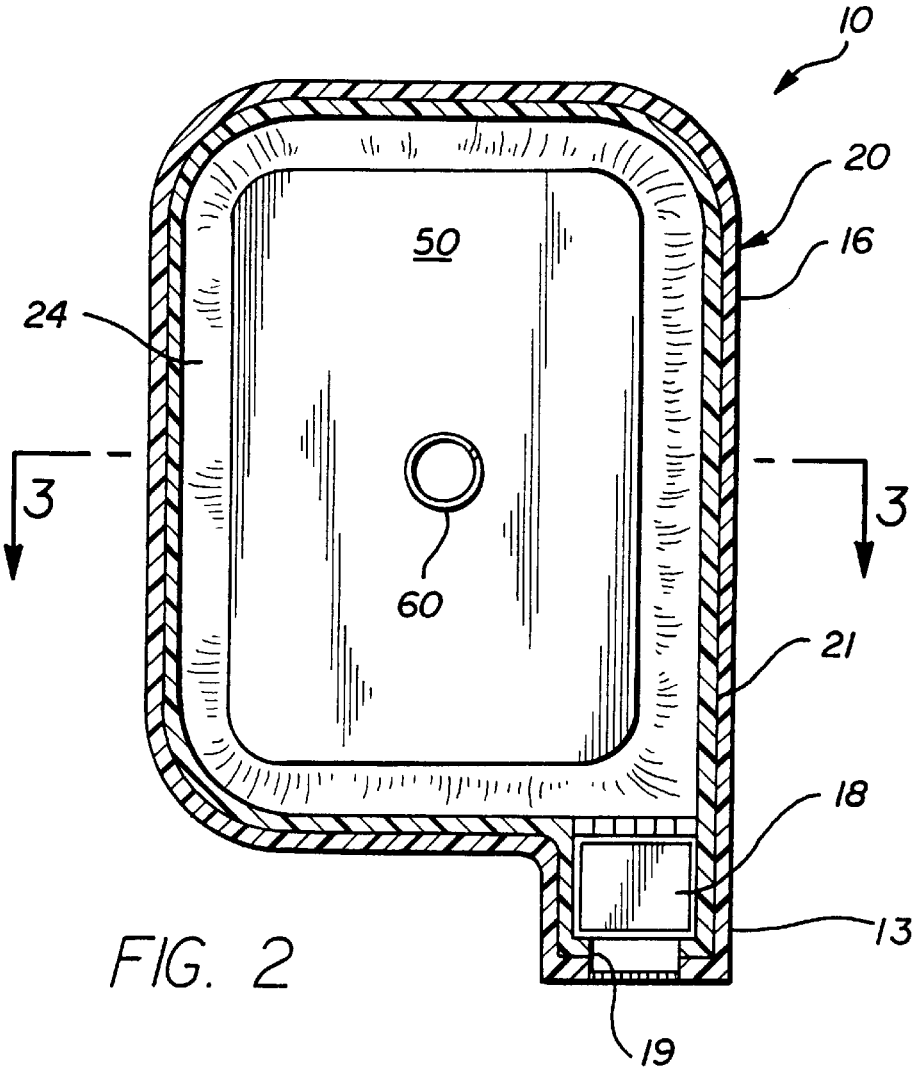
FIG. 2 is a vertical cross section of the cartridge of FIG. 1.

Frame 20 may be constructed with some flexibility to assist in mounting it in the housing 10 but is rigid relative to the flexible membranes described below. The frame 20 has a pair of opposite side edges 21 to which a pair of flexible membranes 22, 24 are respectively joined as by heat welding at their peripheral edges to form the reservoir structure 25. The reservoir structure 25 preferably contains a pressure regulator 30 which in turn is comprised of a pair of spaced substantially parallel plates 40, 50 urged apart by a spring 60 into engagement with the flexible membranes 22, 24. The assembled reservoir structure including the inner frame 20, membranes 22, 24 and pressure regulator 30 is then mounted inside of wall section 16 of the cartridge and side walls 12, 14 are then affixed to the cartridge housing peripheral wall 16. The snout portion 13 of housing 10 also contains an ink filter 18 which is placed in fluid communication with the flexible ink bag reservoir. The filter 18 may be mounted inside the reservoir structure or the it can be positioned outside of the reservoir structure but inside outer housing 10 with minor porting and seal modifications to ensure fluid communication from the ink reservoir to the filter 18. The lowermost portion of the peripheral outer housing wall 16 (as viewed in FIG. 1) is provided with an ink discharge aperture 19 (FIG. 2) through which ink is downwardly discharged from the filter 18 to the print head, not shown.

Figure 3:
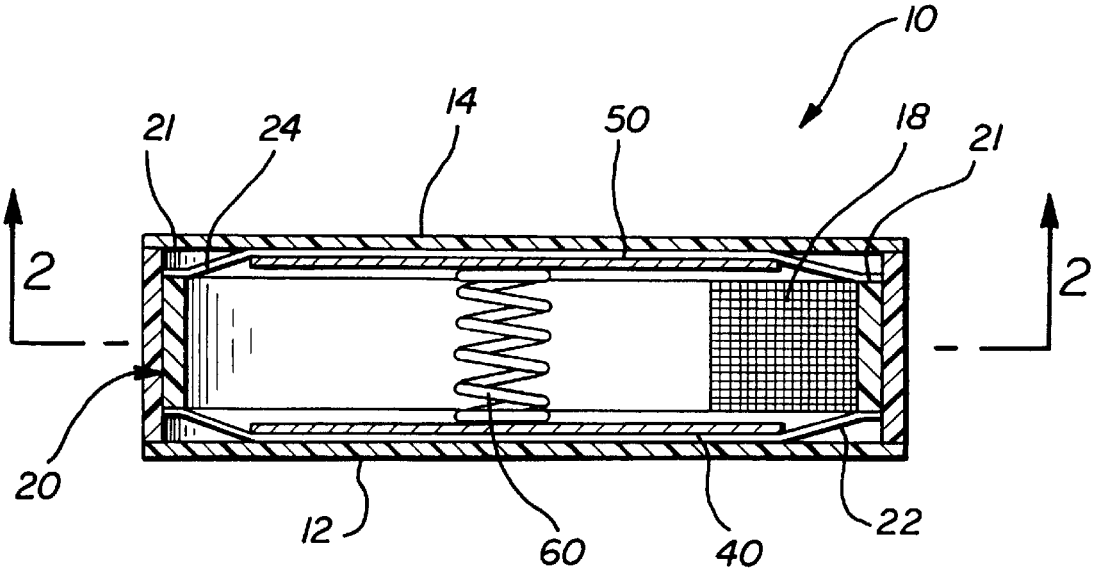
FIG. 3 is a cross sectional plan view of the cartridge of FIG. 1.

The pressure regulator side plates 40, 50, best seen in FIG. 3, are of generally rectangular configuration with rounded corners to avoid damaging the flexible bag membranes 22, 24. Prior to or simultaneous with attachment of the membranes 22, 24 to the sides of inner frame 20, the regulator 30 is placed in the inner frame 20 by collapsing it partially against the spring force such that it initially occupies a prestressed condition inside the ink bag formed by the inner frame 25 and membranes 22, 24. The amount of this prestressing is readily controllable by the designer by selecting the desired degree of compression of the spring 60.

The flexible membranes 22, 24 and the pressure regulator sideplates 40, 50 gradually move towards each other as the reservoir is evacuated of ink. The membranes 22, 24 are sized with enough extra membrane material near their edges of attachment to the inner frame 20 such that they are freely moveable with the side plates between full and empty positions as best indicated in FIG. 3. This permits most of the ink in the reservoir structure 25 to be used before the cartridge is discarded or refilled, as the case may be.

Ideally, both sideplates 40, 50 and the spring 60 are made of a non-corrosive sheet metal such as stainless steel and the inner frame 20 and bag membranes 22, 24 are made of inert plastics which do not react with print ink.

Persons skilled in the art will readily appreciate that various modifications can be made from the preferred embodiment of the invention disclosed herein and that the scope of protection is intended to be defined only by the limitations of the appended claims.

We claim:

1. A method of ink-jet printing using a printer ink cartridge having an ink reservoir structure in which ink is maintained under negative pressure, comprising:

providing the printer ink cartridge comprising a) a rigid frame having a pair of peripherally extending spaced parallel edges on opposite sides thereof, said edges lying in spaced planes, and an ink discharge port in said frame between said planes, b) a first flexible membrane having a peripheral edge sealingly joined to one of said spaced parallel edges of said frame, and c) a second flexible membrane, separate from said first membrane, having a peripheral edge sealingly joined to the other of said spaced peripheral edges of said frame without any direct physical connection between the first and second membranes, and said peripheral edges of said first and second membranes providing respective first and second sealed junctions generally circumscribing an entire perimeter of said ink reservoir, said first and said second membranes having surfaces spaced inwardly from said edges of said membranes which move toward each other as ink is removed from the reservoir and form, with said frame, said ink reservoir structure, and said first and second membranes are freely movable between a full position and an empty position;

providing a supply of ink in said ink reservoir;

passing ink from said ink reservoir through said ink discharge port, with said first and second flexible membranes moving toward each other as ink is withdrawn from said reservoir and passed through said ink discharge port.

2. A method of ink-jet printing using a printer ink cartridge having an ink reservoir structure in which ink is maintained under negative pressure, comprising:

providing a printer ink cartridge comprising a rigid housing containing an ink reservoir structure, said structure including a) a rigid frame having a pair of peripherally extending spaced parallel edges on opposite sides thereof, said edges lying in spaced planes, and an ink discharge port in said frame between said planes, b) a first flexible membrane having a peripheral edge sealingly joined to one of said spaced parallel edges of said frame, c) a second flexible membrane, separate from said first membrane, having a peripheral edge sealingly joined to the other of said spaced parallel edges of said frame without any direct physical connection between the first and second membranes, said peripheral edges of said first and second membranes providing respective first and second sealed junctions which generally circumscribe an entire perimeter of said ink reservoir, said first and said second membranes having surfaces spaced inwardly from said edges of said membranes which move toward each other as ink is removed from the reservoir and form, with said frame, said ink reservoir structure, and said first and second membranes are freely movable between a full position and an empty position, d) an ink pressure regulator disposed between said first and second membranes, and e) wherein the rigid housing includes a peripheral wall and a pair of spaced side plates affixed to said wall, said peripheral wall having an ink discharge opening;

providing a supply of ink in said ink reservoir;

passing ink from said ink reservoir through said ink discharge opening, with said first and second flexible membranes moving toward each other as ink is withdrawn from said reservoir and passed through said ink discharge opening.

3. The method of claim 1 wherein said regulator comprises a pair of spaced substantially parallel flat side plates and a spring urging said plates apart from each other into engagement with said membranes.

* * * * *